United States Patent [19]

Cholley

[11] Patent Number: 4,896,494

[45] Date of Patent: Jan. 30, 1990

[54] WIRING AND TAPING LINE INSTALLATION

[76] Inventor: Christophe Cholley, 42ter Grande Avenue, 60260 Lamorlaye, France

[21] Appl. No.: 276,372

[22] Filed: Nov. 23, 1988

[30] Foreign Application Priority Data

Aug. 31, 1988 [FR] France ..... 88 11396

[51] Int. Cl.[4] ..... D07B 3/12; D07B 3/10; H01B 13/02; H01B 13/08

[52] U.S. Cl. ..... 57/6; 57/3; 57/13; 57/58.52; 57/58.63

[58] Field of Search ..... 57/3, 6, 13, 15, 58.52–58.57, 57/58.63, 314

[56] References Cited

U.S. PATENT DOCUMENTS

| | | | |
|---|---|---|---|
| 1,319,982 | 10/1919 | Wieczoreck | 57/3 |
| 1,858,528 | 5/1932 | Somerville | 57/58.63 |
| 1,900,310 | 3/1933 | Somerville | 57/58.63 |
| 3,147,581 | 9/1964 | Godderidge | 57/58.63 |
| 3,271,941 | 9/1966 | Haugwitz | 57/15 |
| 4,434,608 | 3/1984 | Hartmann | 57/314 X |
| 4,498,281 | 2/1985 | Wraight | 57/58.52 X |

*Primary Examiner*—John Petrakes

*Attorney, Agent, or Firm*—Albert L. Jeffers; John F. Hoffman; Anthony Niewyk

[57] ABSTRACT

A wiring installation comprising a taping head (8), which installation is characterized in that the taping head (8) includes:

A—an exterior assembly (81) which rotates in relation to the general axis (XX') and which includes an assembly for guiding the cable before and after the taping with an input (82) and an output (83) arranged in accordance with the direction of the general circulation of the cable in the installation, this direction relating to the unwinding axis (XX'), B—an interior assembly (84) which rotates in relation to the general axis (XX'), independently of the exterior assembly (81) and including a taping assembly (85), where the input (86) and output (87) of the cable of this interior taping assembly (84) are arranged in a direction opposed to the general cable unwinding direction in the installation, C—an assembly for guiding the cable from the exterior assembly towards the input of the interior assembly and for taking up the taped cable at the output of the interior assembly to cause the cable to circulate in the interior assembly (84).

15 Claims, 6 Drawing Sheets

WIRING AND TAPING LINE INSTALLATION

BACKGROUND OF THE INVENTION

The invention relates to a wiring installation comprising a taping head which serves to encircle the cable with a tape, and a station which receives the taped cable, where these means are together aligned with an unwinding and rotation axis XX' which defines the general unwinding direction of the cable in the installation, and where the stranded cable rotates about the axis downstream of the stranding point whilst the means by which the constituent strands of the cable are emitted do not rotate about the axis, to form a cable taped in the opposite direction to that of the stranding.

A wiring installation of this type is already known.

Conventionally a cable is manufactured in several stages, i.e. firstly the stranding of the constituent strands. The wire rope thus formed is received in a capstan, for example of the "Cook" type, which ensures both the guidance and the traction of the wire rope on a reel. Then the reel, which carries the adequate length of cable, is taken again for passing the wire rope through a taping machine.

An installation of the above-described type also exists which comprises, in a line arrangement, a stranding station including a stranding die, a taping head and a capstan, for example of the "Cook" type, which winds taped cable.

In this known installation, the means which emit the constituent strands are fixed in space and the assembly formed by the means located downstream of the stranding point at which the wire ropes are formed rotates about the axis of the installation in order to preserve the stranding and to prevent it opening until it is wound on the reel in the capstan. In this installation the taping head rotates about the general axis in a direction opposite to that of the rotation of the wire rope. The aim is to add the angular speed of the wire rope and of the taping head so as to increase production without increasing the absolute speed of the taping head. As will be explained later in the description making reference to FIGS. 2 and 3, this oppositely-directed rotation of the taping head and of the wire rope produces a helical taping orientated in the same direction as the windings of the wire rope.

When the cable production is carried out in discontinuous stages with respective take-ups on a reel, it is possible to carry out the taping in an opposite direction to that of the windings of the wire rope since here, when the wire rope has been unwound from its reel in order to proceed to the taping head, the wire rope does not need to rotate aboout the axis of the installation. However, this is conditional upon a discontinuous procedure rather than a line arrangement on the stranding die.

However, if taping is to be carried out in the opposite direction in the known line installation described in the aforegoing, the taping head must rotate in the same direction as the wire rope but at a speed which must be in the order of double that of the wire rope in order to achieve a taping at the same pitch as the wire rope but in the opposite direction.

A solution of this kind cannot be envisaged if the stranding and rotation speeds of the wire rope which can be utilised in practice in such an installation are respected, said speeds being necessary for economic grounds in the manufacturing process. In effect, the rotation speed of the taping head would be unrealisable under acceptable conditions in a technological specification because of the influence of the very considerable centrifugal force on the tape reel and on the rotating electromagnetic brakes of the taping head; a degreasing of the ball bearings and a deformation of the structure would likewise result. Indeed, it would be virtually impossible to maintain a correct dynamic equilibrium. At the level of the transmission of the signals and the electrical supply of the taping head, the high linear speed of the ring/brush assemblies would be a very grave obstacle. Furthermore, the tape used to achieve the taping would be subjected to considerable centrifugal and aerodynamic effects which would prevent correct taping.

A solution of this kind which consists of doubling or substantially increasing the speed of the taping head in order to achieve a taping in the opposite direction to the winding of the wire rope is not possible in current installations.

SUMMARY OF THE INVENTION

The aim of the present invention is to provide a wiring installation which permits the formation of a cable comprising stranded constituent conductors and with a taping in the opposite direction to the winding of the wire rope, without detriment to the manufacturing speed and without any interruption in load.

For this purpose, the invention relates to an installation of the type described in the aforegoing characterised in that the taping head comprises:

A—An exterior assembly which rotates in relation to the general axis XX' and which comprises means for guiding the cable before and after the taping with an input and an output arranged in accordance with the direction of the general circulation of the cable in the installation, this direction relating to the unwinding axis XX'.

B—An interior assembly which rotates in relation to the general axis XX', independently of the exterior assembly, and comprising a taping means, where the input and output of the cable of this interior taping assembly are arranged in the opposite direction to the general unwinding direction of the cable in the installation, with a taping path between the input and the output of this interior assembly situated in accordance with the general axis XX' but orientated in an opposite direction to the general unwinding direction.

C—Means for guiding the cable from the exterior assembly towards the input of the interior assembly and for taking up the taped cable at the output of the interior assembly to cause the cable to circulate in the interior assembly in a circulation direction which is opposed to the general circulation direction relative to the general axis XX'.

D—Means for transmitting control and supply signals from monitoring and control means of the interior taping assembly.

Thus, by virtue of the installation, the wiring is carried out in a line arrangement, i.e. in a continuous fashion without any interruption in load and with taping in the opposite direction to that of the stranding. This is possible thanks to the reversal of the unwinding direction of the wire rope (already taped or not with a tape in the same direction as the wire rope) inside the taping head. In effect, in this taping head which carries out taping in the opposite direction, the wire rope or the taped cable behaves as a wire stranded in accordance with an inverse pitch. The taping head is thus able to rotate at a normal speed in this art without the need to resort to doubling the rotation speed as would be necessary in theory if a wire rope were to be taped in the reverse direction in the known wiring installation.

In accordance with another characteristic of the invention, the exterior assembly comprises two end plates which are driven so as to rotate in synchronism and of which one bears the cable guidance means upstream of the taping means and the other bears the cable guidance means at the output of the taping means.

In accordance with another characteristic of the invention, the exterior assembly comprises a support which forms a store which accommodates taping reels.

In accordance with another characteristic of the invention the exterior assembly comprises a tube located on the axis and bearing the interior assembly in free rotation.

In accordance with another characteristic of the invention the interior assembly comprises a first tube mounted by bearings on the tube of the exterior assembly, where this first tube is provided with a collar which bears a braking element which serves to brake the unwinding of the tape reel, which latter is itself supported by a second tube freely rotating on the first tube.

In accordance with another characteristic of the invention the tube of the exterior assembly and the tube of the interior assembly bear rings which cooperate with brushes which form part of an assembly provided with a counter-weight and rotating freely about the tubes forming part of the transmission means.

In accordance with another characteristic of the invention the means for transmitting the movement of the interior assembly from the exterior comprises a pulley which is integral with the tube of the interior assembly and which cooperates with a pulley supported by a shaft which is in a fixed position in relation to the exterior assembly which crosses the end plate of the exterior assembly and is provided on its exterior with a wheel which cooperates with a wheel mounted so as to rotate freely on the tube on the exterior of the exterior assembly, where this wheel is integral with a wheel driven by a motor.

In accordance with another characteristic of the invention the exterior assembly comprises a rotation drive means which is formed by a pulley which is integral with the tube of the exterior assembly and which is driven in rotation by a motor.

In accordance with another characteristic of the invention the different drive motors are controlled from a central station which controls the speed of the different stranding and taping means.

In accordance with the invention the means for transmitting signals from the interior assembly to the exterior via the exterior assembly is formed in a very simple fashion without the ring/brush contact assembly being subjected to the influence of the centrifugal forces. In effect, the brushes float in a virtually fixed position since this assembly is mounted so as to rotate freely on the tube of the exterior assembly and on the tube of the interior assembly. Only the rings are subjected to the centrifugal forces. At the output of the tube of the exterior assembly, beyond the exterior assembly, a further series of rings is provided which cooperate with fixed brushes connected to the control station.

The mechanical transmission of the rotation movement of the interior assembly from the fixed motor located on the exterior is likewise independent of the movement of the exterior assembly by virtue of the fact that the transmission via a shaft and pinions or pulleys on both sides of the wall of the exterior assembly renders this exterior assembly "transparent". This situation is achieved if the transmission ratios result in an overall ratio of 1. It is possible to play on this ratio to obtain particular effects.

DESCRIPTION OF THE DRAWINGS

The invention will be described in further detail making reference to the attached drawings in which.

DETAILED DESCRIPTION OF THE INVENTION

Figure 1:
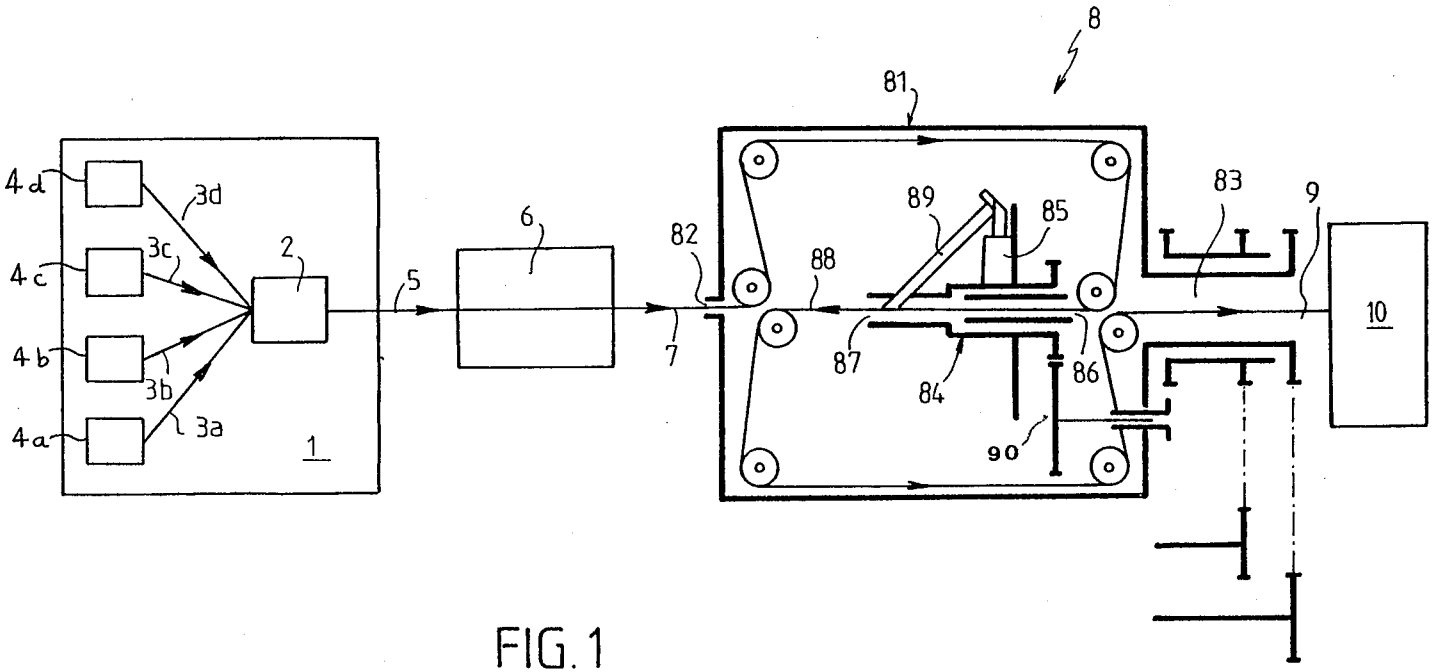
FIG. 1 is an overall schematic view of an installation for the manufacture of cables in accordance with the invention.

In accordance with FIG. 1, the invention relates to a wiring installation which comprises a stranding station 1 with a stranding head 2 which receives the constituent cable strands 3*a*, 3*b* and 3*c*, 3*d* supplied by strand supply means 4*a*,4*b*,4*c*,4*d* which are immobile in space. Downstream of the stranding station the cable 5 may enter a taping station 6 which applies a tape in the stranding direction whereupon the taped cable 7 enters a taping head 8 in which taping is carried out in an opposite direction to the stranding or to the taping performed by the taping head 6. At the output of the taping head 8 the cable 9 enters a receiving means 10 in which the cable is stretched and guided on a reel.

The various means described in the aforegoing, i.e. the stranding station 1, the taping head 6, the taping head 8 and the receiving means 10 are located on an axis X—X′ and rotate, as the case may be, about this axis X—X′; the general unwinding of the cable takes place in accordance with FIG. 1 from left to right, i.e. in the direction X—X′. This general unwinding does not take into account the particular unwinding of the cable in one station or another which, as will be described in the following, differs from the direction X—X′ and is locally reversed, i.e. in the direction X′—X.

Considered in further detail, the taping head 8 comprises an exterior assembly 81 which rotates in relation to the axis X—X′ and which comprises means of guiding the cable 7 in front of and after the taping; this exterior assembly has an input 82 and an output 83 arranged in the general circulation direction of the cable in the installation.

The head likewise comprises an interior assembly 84 which likewise rotates in relation to the axis X—X′ but independently of the rotation of the exterior assembly 81. This interior assembly is provided with a taping means 85.

The input 86 and the output 84 of the cable of this interior taping assembly 84 are arranged in the opposite direction to the general unwinding direction of the cable, i.e. the input 86 is located on the side X' and the output 87 on the side X. Between the input 86 and the output 87 is arranged the taping path 88 at which level the tape 89, supplied by the taping means 85, passes over an opening in the assembly 84 and is wound around the cable in an opposite direction to the stranding direction.

Figure 5A:
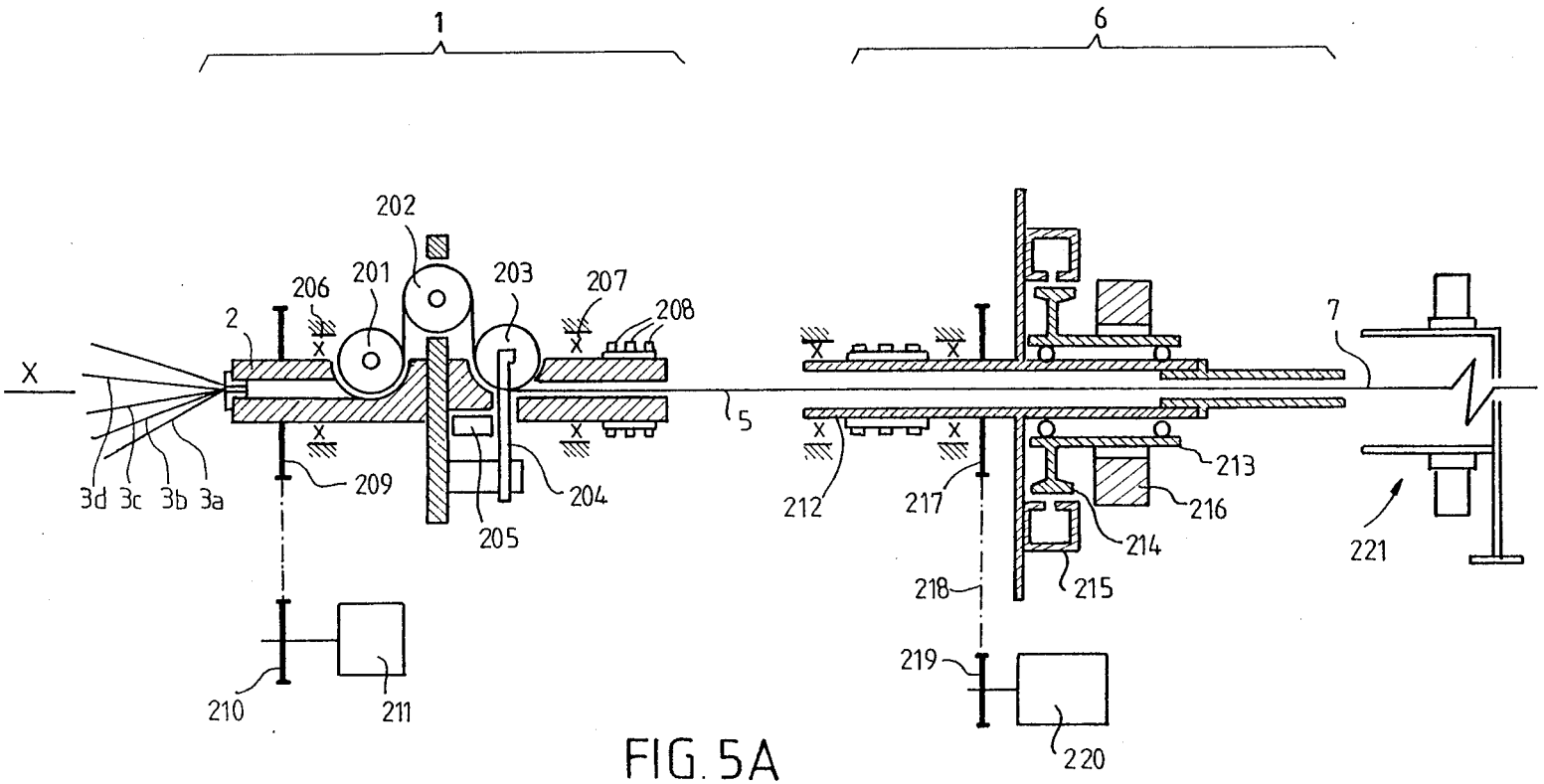
FIGS. 5A, 5B, 5C, which are to be considered in juxtaposition in this order along the axis, schematically represent a cable manufacturing installation in accordance with the invention.
Figure 5B:
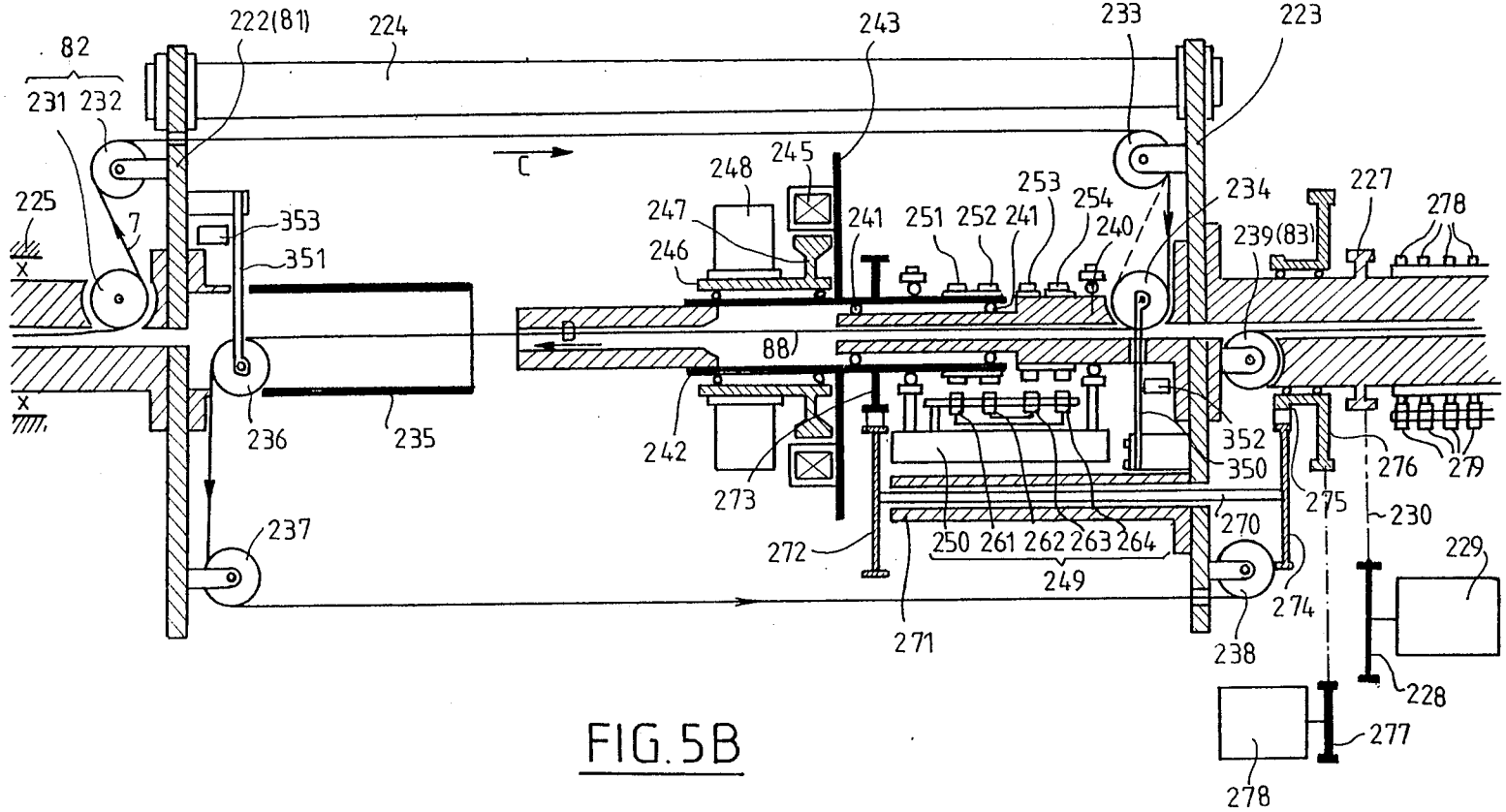
Figure 6:
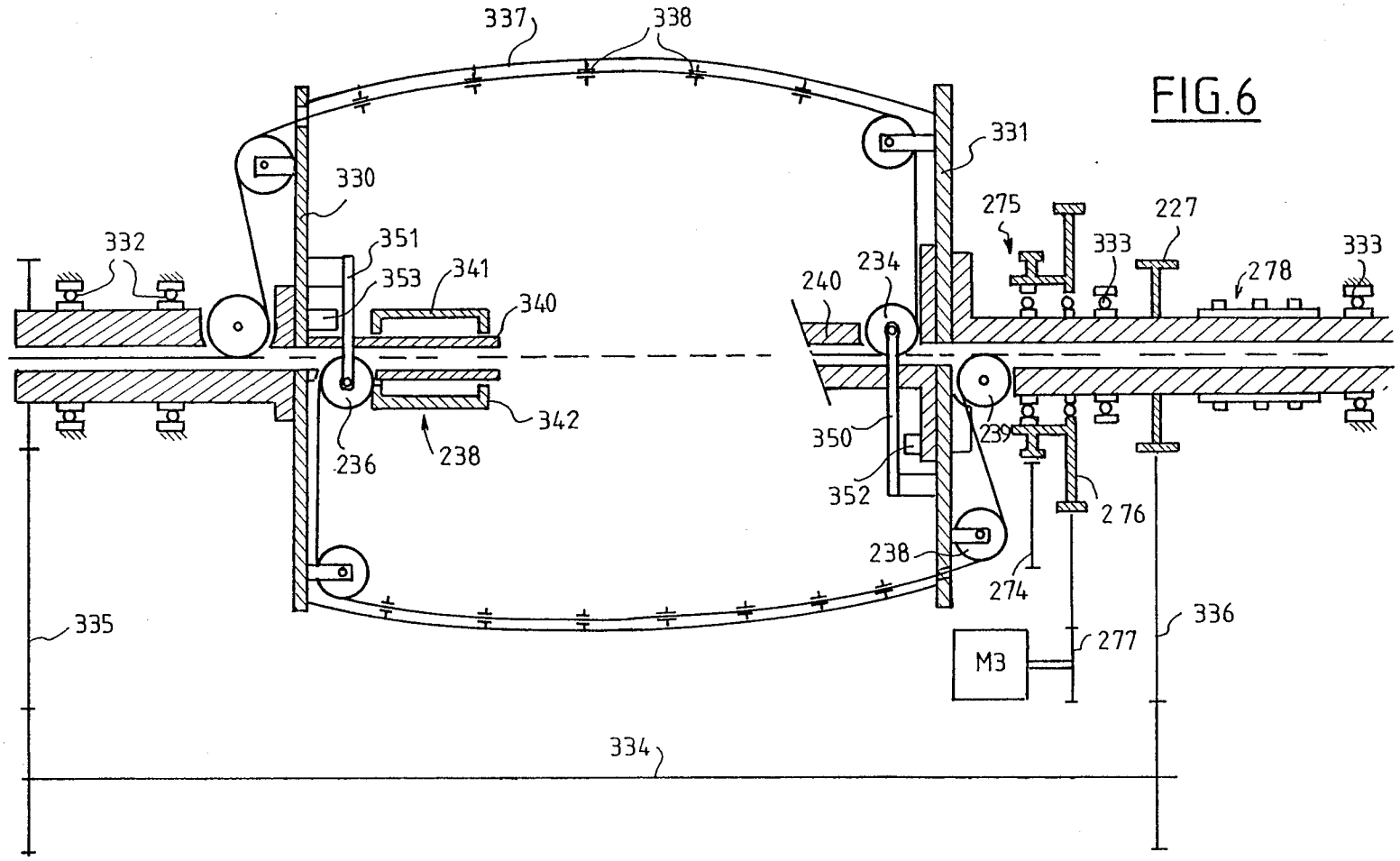
FIG. 6 schematically illustrates another embodiment of the taping head.

It should be noted that it is conceivable to provide different circuits of the wire rope in the section 8 in order to reverse the direction of the taping, whilst the circuit illustrated in FIG. 1 or FIGS. 5B and 6 is the simplest.

The taping head is likewise provided with a means for transmitting control signals and supply signals which connect the exterior of the head to the interior taping assembly 84, i.e. to the monitoring and control means of the functioning of this interior assembly 84 via the exterior assembly 84 which becomes "transparent"; this signifies that the transmission means connect the interior means 84 to the exterior independently of the direction of rotation and the speed of rotation of the exterior assembly 81 and the interior assembly 84.

Figure 2:
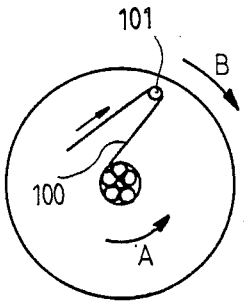
FIGS. 2 and 3 respectively are schematic front and perspective views of taping operations in which the taping direction is identical to the stranding direction.
Figure 3:
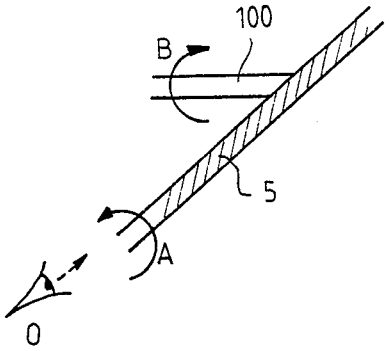

FIGS. 2 and 3 schematically illustrate the classical taping principle which consists of carrying out, downstream of the stranding die, taping in the direction of the stranding, where said taping is performed by the taping head 6.

In the drawings the cable 5 circulates backwards away from the eye 0 of the observer. The stranded cable 5 rotates on its own axis in the direction of the circular arrow A. On the other hand, the tape 100 unwound by the taping head which is represented by the return pulley 101 rotates in the direction of the arrow B, i.e. in an opposite direction to the direction of rotation of the wire rope 5. The tape is thus applied to the wire rope 5 as shown in the right-hand section of FIG. 3. It can thus be seen that the tape forms a winding in the same direction as the windings of the wire rope 5, although the pitch can be different.

Figure 4:
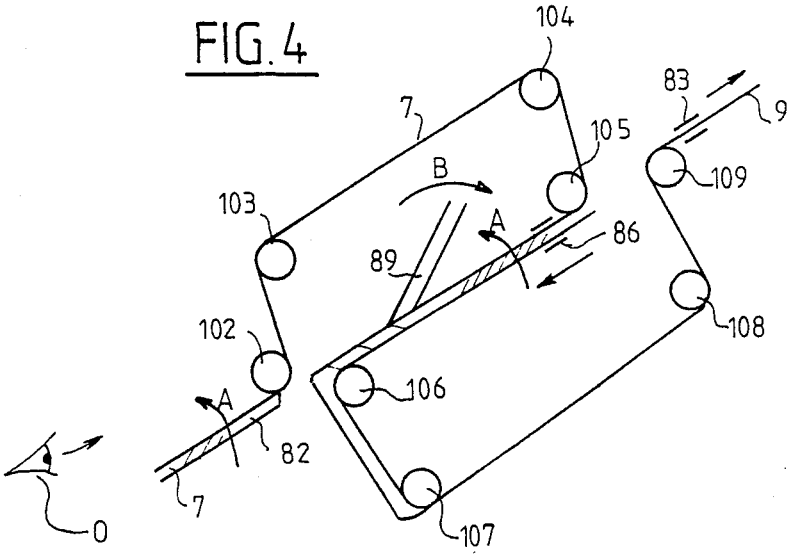
FIG. 4 is a fundamental schematic view of the taping head in accordance with the invention in which the taping takes place in the opposite direction to the stranding.

FIG. 4 schematically illustrates the taping carried out by the taping head 8 in FIG. 1.

The same orientation principles as in the aforegoing have been employed in FIG. 4. The orientation is based on the eye 0 of the observer and the references of FIG. 1 have been used to designate the same elements in FIG. 4.

In accordance with FIG. 4 the cable 7, which emanates for example from the taping head 6 (in accordance with FIG. 3) and which still rotates in the direction of the circular arrow A, is unwound by guidance means 102,103,104,105 of the exterior assembly (not shown) between the input 82 of the exterior assembly and the input 86 of the interior assembly. The turns of the wire ropes have been shown on the cable 7.

At the level of the taping path, by virtue of the rotation of the exterior assembly, the cable 7 still rotates in the direction of the arrow A.

The interior assembly which carries out the taping rotates in the direction of the arrow B in opposite to the direction of the arrow A. The tape 89 is thus positioned around the cable 7 to form the cable 9; the latter is guided by the guidance means 106,107,108,109 towards the output 83 of the exterior assembly. This figure shows clearly that the winding formed by the tape 89 on the cable 9 is opposed to the windings of the wire ropes and as the case may be of the tape of the upstream taping station(s).

FIG. 3 shows clearly that the wire rope 5 and the taping are formed by rotation in the opposite direction resulting in taping wound in the same direction as the wire rope.

If, under the conditions of FIG. 3, it were desired to carry out taping in the opposite direction to the wire rope, it would be necessary (by opposing stranding and taping pitches) to cause the taping head to rotate at a rotation speed in the same direction but with an amplitude of double that of the wire rope, which is impossible.

The solution to this difficulty is to reverse the unwinding direction of the cable or the wire rope (FIG. 4) which permits, by means of taping in one rotation direction and a movement of the taping head in the opposite direction, the formation of a tape wound in the opposite direction to the wire rope.

Figure 5C:
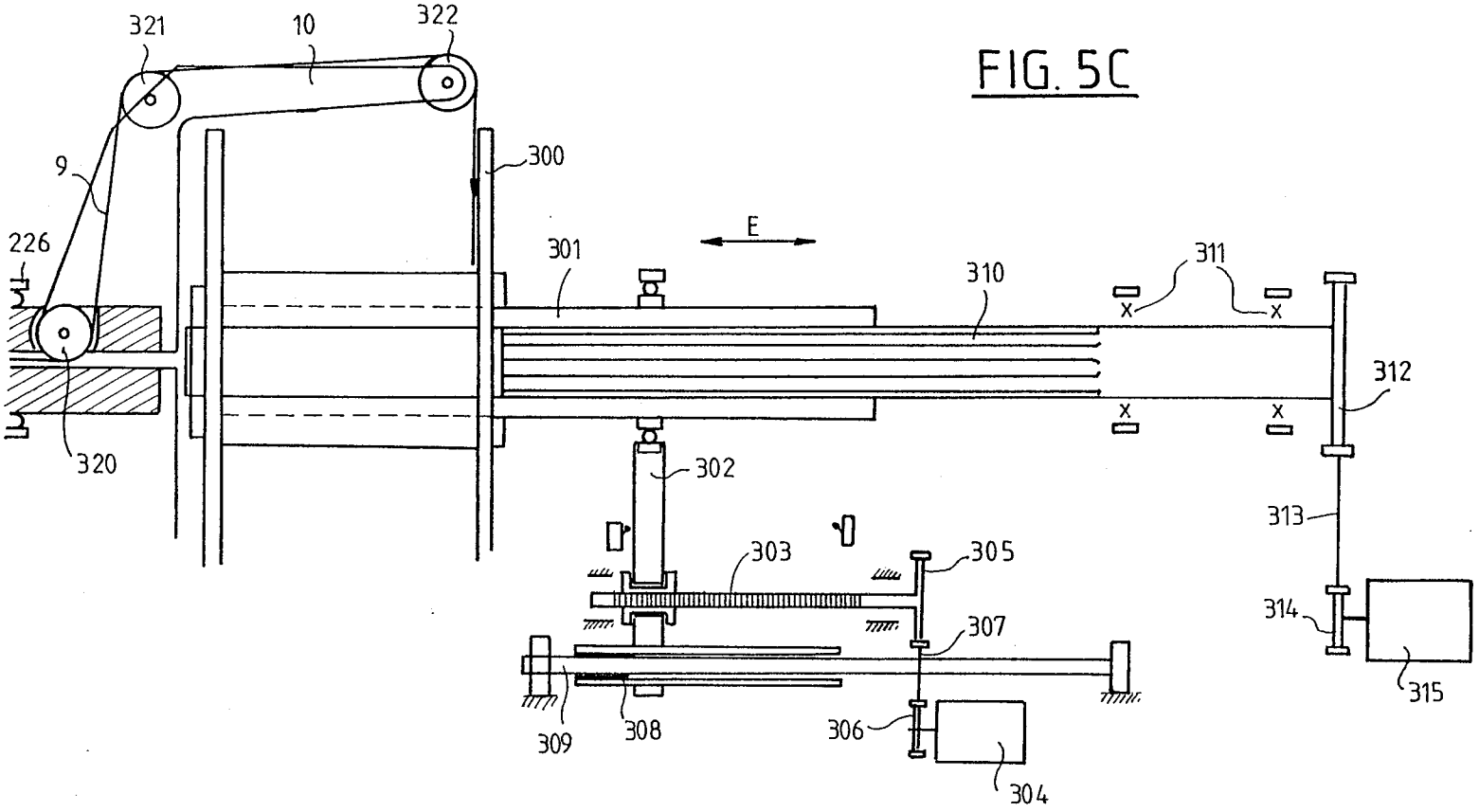

FIGS. 5A,5B,5C, which are intended to be combined in this order in accordance with the axis X—X', represent a more detailed wiring installation than FIG. 1.

In accordance with FIG. 5A, the stranding station 1 shows the stranding die 2 which receives constituent cable strands *3a, 3b,3c,3d*. In accordance with the rotation of the die 2 about the axis X—X' at a rotation speed chosen as a function of the unwinding speed of the cable and the chosen pitch, the stranded cable 5 is obtained at the output of the die. This die comprises return pulleys 201,202 which form a barrier which blocks the point of reunion of the constituent strands and thus preserves a precise torsion of the wire rope downstream of this means. Furthermore, the pulley 203 is mounted on the flexible arm 204 of a tension sensor 205. The distance of the arm 204 relative to the sensor 205 allows the tension of the cable 5 to be determined. This figure likewise shows the bearings 206 and 207 in which rotate the die and the rings 208 for the transmission to the exterior of the signals supplied by the sensor 205. The die 2 is driven to rotate by a toothed wheel 209 which is connected to a motor pinion 210, itself driven by a motor 211 or a general movement distribution shaft, by a notched belt. The motor 211 is controlled by a central synchronisation station which receives the various command or measurement signals for the control of the speed of the motor 211 as a function of the desired stranding.

Downstream of the stranding station 1, FIG. 2A shows the taping head 6. This taping head comprises a rotating section 212 which bears the taping means 213. The taping means 213 is formed by a sleeve mounted so as to rotate freely on the tube 212 via bearings. The sleeve bears a wheel 214 which cooperates with the wheel 215 which in fact represents the stator of an electromagnetic powder brake. The sleeve 213 receives a tape reel 216. The known tape unwinding means has not been shown. The rotating drive of the tube 212 is provided by a toothed wheel 217 and a notched belt 218 driven by the wheel or the pulley 219 of a motor 220 whose rotation speed is controlled by a speed command so as to achieve the desired taping pitch. This taping head 6 functions as indicated in the aforegoing and as described making reference to FIGS. 2 and 3: the tape applied to the wire rope corresponds to a winding in the same sense as the windings of the wire rope.

At the output the taping head 6 is provided with a fixed support 221 crossed by the cable 7. Before the start-up of the machine and the attachment of the cable the support is supplied with one or more reserve reels 222. When the reel of the head 6 is empty, the carrier core of the empty reel is destroyed and the full reel of the support 221 is slid onto the sleeve 213.

The taping head 8 illustrated in FIG. 5B comprises the exterior assembly 81 which is formed by two end plates 222,223 which bear peripheral elements 224 so as to form a cage. This embodiment can be replaced by two end plates 330,331 (see FIG. 6) each supported by two bearings 332,333, driven so as to move in synchronism and controlled in phase by an exterior transmission which comprises a transmission shaft 334 and pulley and belt connections 335 and 336. Thus the bars 224 can be replaced by simple supporting strips 337 of the cable guidance means 338 (dies).

This exterior assembly which rotates about the axis X—X' in the bearings 225,226 is driven so as to rotate by a wheel 227 (pulley) linked to the pulley 228 of a motor 229 by a notched belt 230. The rotation of the motor 229 is controlled by the central control station and must be in synchronism with the motor 211. A connection could also be formed by a notched belt to the general movement distribution shaft already referred to in the aforegoing.

The exterior assembly 81 likewise comprises the input 82 formed by two pulleys 231,232 which unwind the cable 7 towards the exterior periphery of the head 8. These pulleys 231,232 can likewise be considered to belong to the guidance means of the cable in the exterior assembly (guidance means 102,103,104,105 in FIG. 4). These guidance means are completed in the embodiment illustrated in FIG. 5B by two further pulleys 233 and 234 which return the cable 7 on the axis X—X' but in such manner that the unwinding direction of the cable is at this level opposed to the general unwinding direction. This unwinding direction of the cable is represented by the arrow D whereas the general unwinding direction of the cable is represented by the arrow C.

Downstream of the guidance means 234 which simultaneously represents the input (reference 86) of the interior assembly 84, the cable describes the taping path 88 and at the output of the interior assembly 84 the cable enters a tape reel reserve 235 and then again leaves the axis X—X' to pass the pulley 236 which unwinds the cable towards the exterior, then a return pulley 237 and the pulleys 238,239 which guide the taped cable 9 towards the output. This output 83 is formed, for example, by the pulley 239.

This tape reel reserve is preferably formed as illustrated in FIG. 6 in which the end plate 330 comprises a coaxial sleeve 340 crossed by the cable, where this sleeve supports on its outer surface, via roller bearings, a tube 341 which accommodates the tape reels. Locally this tube represents a heavy mass 342 which forms a counter-weight which maintains this tube and the tape reels in the same angular position on the rotating sleeve 340. This presents the rotation of the full reels which have not yet been used which thus reduces the vibrations and, by this means, the wear of the installation as a whole.

The exterior assembly 84 (FIG. **5*b*) likewise comprises a guidance and support tube 240 about which the interior assembly 84 rotates via the bearing 241 which has been shown schematically. The interior assembly 84 comprises a tube 242 provided with a wheel 243 which bears the brake 245 formed for example by an electromagnetic brake. The tube 242 which has been shown rotating about the tube 240 is driven from the exterior by a means which will be described later in the description. The tube 242 bears, rotating freely, a tube 246 provided with a flange 247 which constitutes the rotor of the brake 245. The tube 246 accommodates the tape reel 248**.

The supply and the control of the brake 245 are provided by the transmission means of the control and supply signals which is constituted by an assembly 249 "rotating" about the tubes 240,242. In effect, this transmission means comprises an assembly 249 with a counter-weight 250 which maintains the assembly in an immobile position relative to space, whilst permitting the rotation of the tubes 240 and 242 in any direction and at any speed. Additionally, the tubes 240 and 242 are provided on their exterior with contact rings 251,252,253,254 which cooperate with contact brushes 261,262,263,264 connected as the case may be by conductors. This avoids the effects of the centrifugal force on the brushes as the brushes are immobile in space and only the rings 251,252,253,254 rotate to thus transmit the signals from the interior assembly to the exterior assembly or vice versa.

The transmission means 90 is completed by a pulley transmission formed by a shaft 270 extending in parallel to the axis X—X' and whose rotation is interdependent with the exterior assembly 81 in that it is mounted in a bearing 271 of this assembly. One of the ends of this shaft 270 bears a pulley 272 which cooperates with a pulley 273 whose rotation is interdependent with the tube 242 of the interior assembly 84. The other end of the shaft 270 is provided with a pulley 274 which engages with a pulley 275 supported by an assembly which rotates freely relative to exterior assembly 84 and comprises another toothed pulley 276 driven by the pulley 277 at the output of the motor 278. The rotation speed of the motor 278 is controlled.

In this way it is possible to transmit the desired rotation speed to the interior assembly 84 whatever the rotation speed of the exterior assembly 81. The transmission of the signals between the central fixed station achieved by means of rings 278 which cooperate with collector brushes 279 (not shown).

It will also be noted (see FIGS. **5*b* and 6) that the rollers 234 and 236 located upstream and downstream of the taping zone in the unwinding direction of the cable are mounted on the end plates 222,223 and 331,330 respectively by spring blades 350,351 arranged in the vicinity of sensors 352,353, where said sensors produce a signal as a function of the displacement of the blades 350,351 and thus a signal which is a function of the tension to which the cable is exposed upstream and downstream of the taping zone. These means are processed by a calculator assembly whereby, by virtue of their difference and taking into account the winding pitch of the tape, information is obtained relating to the tension of the tape wound on the wire rope. In this way it is possible to regulate the winding tension of the tape. It will also be noted that the signal measured by the upper sensor 352** is a function of the tension of the wire rope at the output of the station located directly downstream. This arrangement is particularly important in the case of installations which comprise several taping heads arranged one after another. The number of sensor measuring assemblies can thus be (N+1 and not 2N (N representing the number of actuated heads).

In the embodiment illustrated in FIGS. 5A to 5C, at the output of the taping head 8 the cable 9 directly enters the receiving means 10 formed by a guidance station which comprises a reel 300 mounted on a grooved guide 301 whose alternating translation movement in the direction of the double arrow E is controlled via the arm 202 and the leading screw 303 which is caused to rotate by a motor 304 via a pulley transmission 305,306 and a belt 307. This arm 302 is guided in translation by a bush 308 which slides on the shaft 309. The bearing 301 is a grooved bearing mounted on a grooved shaft 310 supported by the bearings 311 and driven to rotate by a pulley transmission 312, a belt 313, and a pulley 314 at the output of the motor 315. The rotation of this motor 315 is likewise controlled.

The cable 9 enters the station 10 on the return pulleys 320,321,322 and arrives on the reel 300 which is displaced as already described in the aforegoing in the direction of the double arrow E whilst simultaneously rotating so as to guide the cable on the reel 300.

The different rotation drive motors are controlled in phase and in synchronism from a central station (not shown) which takes into the account the installation and control parameters (pitch of the wire rope, pitch of the different tapings etc.)

Finally it should be emphasised that the number of taping heads is not limited to that described in the above example and that likewise the reception means can consist of a closed cage as in the original "Cook" embodiment.

Furthermore the stranding station 1, instead of receiving only constituent strands *3a,3d*, can be designed to likewise receive a partially formed wire rope which is completed at this station by the addition either of constituent strands or other wire ropes. This partially formed wire rope could be emitted either statically or by the intermediary of a neutraliser known per se, with the aim of adapting in a determinate fashion the rotation of this partially formed wire rope on its own axis as a function of the general movement of the machine.

I claim:

1. A wiring installation comprising a taping head which serves to encircle with a tape a stranded cable formed of a plurality of constituent strands, the stranded cable being rotatable about its longitudinal axis and being fed into the taping head along a rotational axis which defines a general unwinding direction in the installation, said taping head comprising:

an exterior assembly adapted to rotate about said rotational axis and which comprises guiding means for guiding a cable both before and after taping thereof in said taping head, said exterior assembly including an exterior input and an exterior output for a cable, said exterior input and output operatively arranged relative to said general unwinding direction;

an interior assembly which rotates about said rotational axis, independently of said exterior assembly, and comprising a taping means, said interior assembly including an interior input and an interior output for a cable, said interior input and output operatively arranged in the opposite direction of said general unwinding direction, a taping path located between said interior input and said interior output and operatively arranged relative to said rotational axis but, said taping path oriented in the opposite direction to said general unwinding direction;

guiding means for guiding the cable from said exterior input towards said interior input and for taking up the cable at the interior output to cause the cable to circulate in the interior assembly in a direction which is opposite to said general unwinding direction;

a monitoring and control means for connecting said interior assembly to said exterior assembly; and means for transmitting control and supply signal from said monitoring and control means to said taping means.

2. An installation as claimed in claim 1, further comprising a nonrotating strand supply means for emitting a plurality of constituent strands, a stranding station having a stranding die for receiving a plurality of constituent strands from said strand supply means and for forming a stranded cable, said stranding station operably connected upstream of said taping head, the stranded cable adapted to rotate about said rotational axis downstream of said stranding die, said exterior assembly adapted to rotate in the same direction and at the same speed as the stranded cable formed in said stranding die.

3. An installation as claimed in claim 2, including a first motor for driving said exterior assembly and second motor for driving said interior assembly, said first and second drive motors being controlled by a central station for effecting control of the speed of the stranding station and taping head.

4. An installation as claimed in claim 2, including a plurality of sensors for measuring the tension to which a cable is subjected, said sensors provided on each side of said taping path for producing sensing signals which are fed to a calculator, said calculator producing information signals in response to said sensing signals as a function of the tension of tape wound on a cable for regulating the tension of the tape.

5. An installation as claimed in claim 2, wherein said taping head further comprises a tape reel reserve arranged coaxially with said taping path, a plurality of tape reels mounted on a sleeve, said sleeve integrally connected with said exterior assembly by means of a tube, said tube including a counter-weight and being freely rotatably mounted on said sleeve.

6. A wiring installation as claimed in claim 1, wherein said exterior assembly comprises first and second end plates which are driven to rotate in synchronism, said guiding means including upstream guiding means and downstream guiding means, said first end plate supporting said upsteam guiding means for guiding the cable at said interior input, said second end plate supporting said downstream guiding means for guiding the cable at said interior output.

7. An installation as claimed in claim 1, wherein said exterior assembly comprises a tube oriented coaxially with said rotational axis and including bearing means for freely rotatably supporting said interior assembly.

8. An installation as claimed in claim 7 wherein said interior assembly comprises a first tube supported by a bearing on a second tube, said first tube provided with a collar which supports a braking means for braking a tape reel, said tape reel supported on a third tube which is freely rotatably supported on said first tube.

9. An installation as claimed in claim 1, wherein said interior assembly comprises a first tube supported by a bearing on a second tube, said first tube provided with a collar which supports a braking means for braking a tape reel, said tape reel supported by a third tube which is freely rotatably supported on said first tube.

10. An installation as claimed in claim 9, wherein said second tube and said first tube support a plurality of rings which cooperate operatively with a plurality of brushes of a transmission means for independently rotating said interior assembly, said transmission means including a counter-weight and being rotatably oriented for rotating freely about said first and second tubes.

11. An installation as claimed in claim 10, wherein said means for transmitting control and supply signals comprises a first pulley which is integral with said first tube and which cooperates with a second pulley which is supported by a shaft, said shaft being fixed in positive relative to said exterior assembly, said exterior assembly including an end plate, said shaft extending through said end plate, said shaft having a first wheel secured thereto exteriorly of said exterior assembly, said first wheel cooperating with a second wheel, said second wheel rotatably mounted to rotate freely on said second tube exteriorly of said exterior assembly, said second wheel being integral with a third wheel, and a motor drivingly connected to said third wheel.

12. An installation as claimed in claim 1, wherein said exterior assembly comprises a rotation drive means for rotating the exterior assembly, said rotation drive means including a tube and a pulley, said pulley being integral with said tube, and a motor drivingly connected to said tube.

13. An installation as claimed in claim 1, including a plurality of sensors for measuring the tension to which a cable is subject, one of said plurality of sensors provided on each side of said taping path for providing sensing signals which are fed to a calculator, said calculator providing information signals in response to said sensing signals as a function of the tension of tape wound on a cable for regulating the tension of the tape.

14. An installation as claimed in claim 13, wherein said taping path is delimited at its ends by cable guiding means for guiding a cable, said cable guiding means being supported by spring blades with which said sensors cooperate.

15. An installation as claimed in claim 1, wherein said taping head further comprises a tape reel reserve arranged coaxially with said taping path, a plurality of tape reels mounted on a sleeve, said sleeve integrally connected with said exterior assembly by means of a tube said tube including a counter-weight and being freely rotatably mounted on sleeve.

* * * * *